US010793310B2

(12) United States Patent
Takeshiba et al.

(10) Patent No.: US 10,793,310 B2
(45) Date of Patent: Oct. 6, 2020

(54) LABEL FITTING SYSTEM

(71) Applicant: Fuji Seal International, Inc., Osaka (JP)

(72) Inventors: Kazuo Takeshiba, Osaka (JP); Henk Weltje, Deurne (NL)

(73) Assignee: Fuji Seal International, Inc., Osaka-shi (JP)

( * ) Notice: Subject to any disclaimer, the term of this patent is extended or adjusted under 35 U.S.C. 154(b) by 87 days.

(21) Appl. No.: 16/086,850

(22) PCT Filed: Feb. 1, 2017

(86) PCT No.: PCT/JP2017/003646
§ 371 (c)(1),
(2) Date: Sep. 20, 2018

(87) PCT Pub. No.: WO2017/163617
PCT Pub. Date: Sep. 28, 2017

(65) Prior Publication Data

US 2019/0106235 A1 Apr. 11, 2019

(30) Foreign Application Priority Data

Mar. 25, 2016 (JP) ..... 2016-062168

(51) Int. Cl.

| | |
|---|---|
| ***B65C 3/16*** | (2006.01) |
| ***B65B 53/00*** | (2006.01) |
| ***B65C 3/14*** | (2006.01) |
| ***B65C 9/18*** | (2006.01) |

(52) U.S. Cl.
CPC ..... *B65C 3/163* (2013.01); *B65B 53/00* (2013.01); *B65C 3/14* (2013.01); *B65C 9/1869* (2013.01)

(58) Field of Classification Search
CPC .. B65C 3/065; B65C 3/08; B65C 3/10; B65C 3/14; B65C 3/163; B65C 3/166; B65C 9/1869; B29C 63/423
See application file for complete search history.

(56) References Cited

U.S. PATENT DOCUMENTS

2002/0002812 A1* 1/2002 Eiban ..... B29C 63/423 53/585

FOREIGN PATENT DOCUMENTS

JP 4391077 B2 12/2009

* cited by examiner

*Primary Examiner* — George R Koch
(74) *Attorney, Agent, or Firm* — Locke Lord LLP

(57) ABSTRACT

Provided is a label fitting system which can, even if a container has a narrowed portion, appropriately fit a cylindrical label to the outer periphery of the container. A label fitting system is provided with a label arrangement mechanism which pushes down a cylindrical label having been supplied to a location above a cylindrical container and is disposed about the outer periphery of the cylindrical label. The label arrangement mechanism is provided with a vertically movable annular base and a plurality of legs extending downward from the base. The legs have elasticity which enables the legs to be displaced radially, and have lower ends coming into contact with the upper end of the cylindrical label. When the base descends, the lower ends of the legs push down the cylindrical label while descending along the outer peripheral surface of the cylindrical container.

20 Claims, 16 Drawing Sheets

[Fig.15]
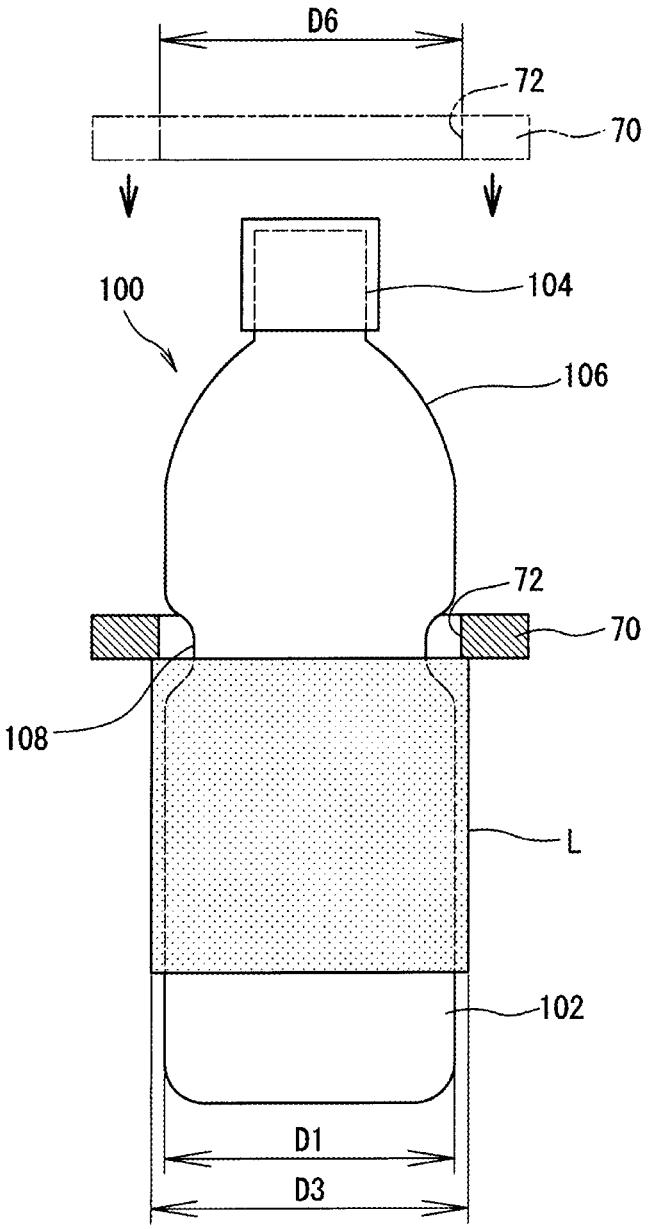

[Fig.16]
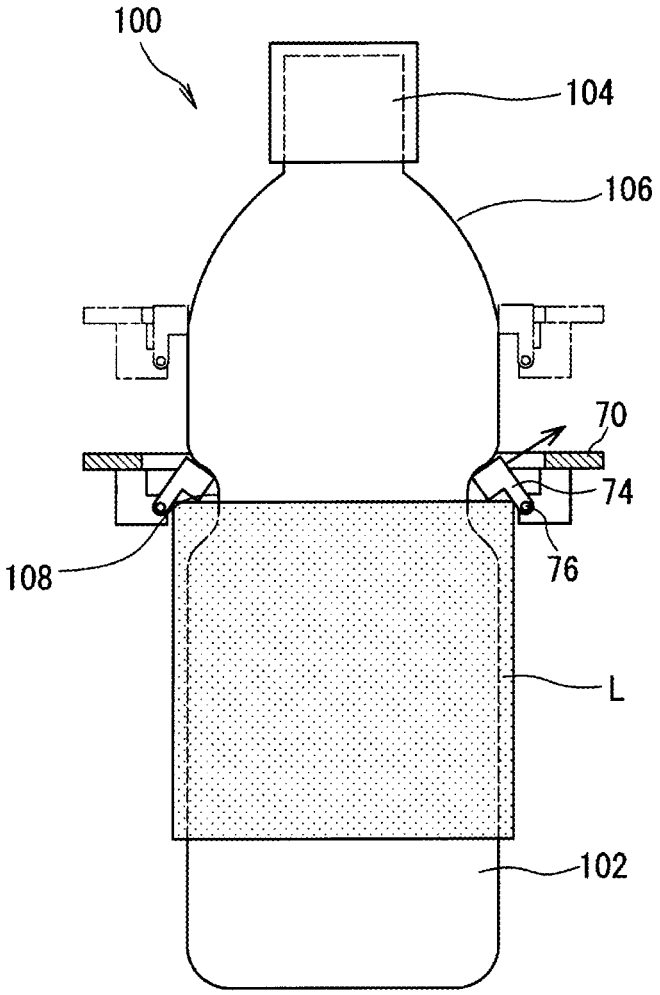

LABEL FITTING SYSTEM

This application is a 371 of PCT/JP2017/003646, filing date 02/01/2017.

TECHNICAL FIELD

The present invention relates to a fitting system that fits a cylindrical label to an outer periphery of a cylindrical container.

BACKGROUND ART

Conventionally, a label fitting system that fits a cylindrical label to the outer periphery of a cylindrical container such as a bottle has been widely known. In such a label fitting system, after a cylindrical label is supplied to a cylindrical container from above, the upper end of the cylindrical label is pushed down to position the cylindrical label at a predetermined height position. For the positioning of the cylindrical label, a technique of pushing down the upper end of the cylindrical label with an annular plate having a hole formed therein through which a portion of the container can be inserted has been known. However, many of the conventional annular plates have formed holes being smaller than the maximum outside diameter of the container and can be descended only to the vicinity of the shoulder portion of the container, and the cylindrical label cannot be pushed down to the lower end. Of course, such a problem can be solved by increasing the size of a hole of an annular plate. However, when the size of a hole of an annular plate is merely increased, the upper end of a label enters the gap between the inner peripheral edge of the annular plate and the outer peripheral surface of the container, leading to another problem that the upper end of the label cannot be suitably pushed by the annular plate. Such a problem may occur even if the label is only slightly deformed or decentered.

CITATION LIST

Patent Literature

Patent Literature 1: Japanese Patent No. 4391077

SUMMARY OF INVENTION

Technical Problem

Patent Literature 1 discloses a technique in which a plurality of claw members is provided on the inner peripheral edge of an annular plate.

The claw member is displaceable and its tip end face is energized so as to come into contact with the outer peripheral surface of a container. While the tip end face of the claw member is coming into contact with the outer peripheral surface of the container, the claw member is descended together with the annular plate so that the upper end of a label is pushed down by the claw member. According to such a technique, a label does not enter the gap between the claw member and the outer peripheral surface of the container.

However, the technique of Patent Literature 1 is unsuitable for label fitting to a container whose outside diameter changes considerably in the middle of a container such as a container having a narrowed portion reduced partially in the middle thereof.

That is, in Patent Literature 1, the claw member is displaced in accordance with the change in diameter of the container such that the tip end face of the claw member comes into contact with the outer peripheral surface of the container. Here, in Patent Literature 1, the claw member is rotatable around the support shaft of a base end portion, and in order to move the tip end face in the radial direction, the claw member needs to rotate obliquely downward relatively considerably. Thus, when the annular plate ascends, the tip end face of the claw member may be caught by the narrowed portion of the container or the like, causing that the ascent of the claw member is hindered. As a result, the technique of Patent Literature 1 cannot be applied to label fitting to a container having a narrowed portion.

Therefore, an object of the present invention is to provide a label fitting system capable of suitably fitting a cylindrical label to the outer periphery of a container even when the container has a narrowed portion.

Solution to Problem

A label fitting system of the present invention is a fitting system that fits a cylindrical label to an outer periphery of a cylindrical container. The label fitting system includes: a label arrangement mechanism that arranges the cylindrical label supplied above the cylindrical container on the outer periphery of the cylindrical container by pushing down the cylindrical label, wherein the label arrangement mechanism includes: a base in an annular shape capable of ascending and descending; and a plurality of legs extending downward from the base, each of the plurality of legs has elasticity capable of being displaced in a radial direction and further has a lower end portion that comes into contact with an upper end of the cylindrical label, and when the base descends, the lower end portion of the leg pushes down the cylindrical label as descending along an outer peripheral surface of the cylindrical container.

In a preferred embodiment, the leg has a leg main body extending downward from the base and the lower end portion of the leg has a label contact portion extending in the radial direction.

In this case, the label contact portion is preferably provided so as to project radially inward from a lower end of the leg main body.

In addition, the lower end portion has an inward projecting portion projecting radially inward from a lower end of the leg main body and the label contact portion is preferably provided so as to project radially outward from the lower end of the inward projecting portion.

In another preferred embodiment, the label contact portion is provided in a direction substantially perpendicular to the leg main body.

In still another preferred embodiment, the leg is arranged so as to extend downward in a direction substantially perpendicular to the base in a no-load state, and the lower end portion of the leg projects inward from an inside diameter position of the base.

In still another preferred embodiment, the leg is made of a plate member or a linear member. When the leg is made of the linear member, at least the lower end portion of the linear member is preferably formed in a U shape.

In still another preferred embodiment, the lower end portion of the leg has a portion that comes into contact with the outer peripheral surface of the cylindrical container when descending. The portion has a smooth surface.

In still another preferred embodiment, at least four legs are provided at equal intervals in a circumferential direction of the base. More preferably, at least eight legs are provided at equal intervals in a circumferential direction of the base.

ADVANTAGEOUS EFFECTS OF INVENTION

According to the present invention, the leg has elasticity capable of being displaced in the radial direction and further includes the lower end portion that comes into contact with the upper end of the cylindrical label. Thus, the leg can be displaced in the radial direction without large posture deformation and can ascend and descend without being caught by the narrowed portion of the container. As a result, even if a container has a narrowed portion, the cylindrical label can be suitably fitted to the outer periphery of the container.

BRIEF DESCRIPTION OF DRAWINGS

FIG. 2(*b*); FIG. 2(*c*); FIG. 2(*d*) are an explanatory diagrams of operation of the label fitting system.

FIG. 15 is a view showing an example of a conventional push-down member.

FIG. 16 is a view showing an example of the conventional push-down member.

DESCRIPTION OF EMBODIMENT

Figure 1:
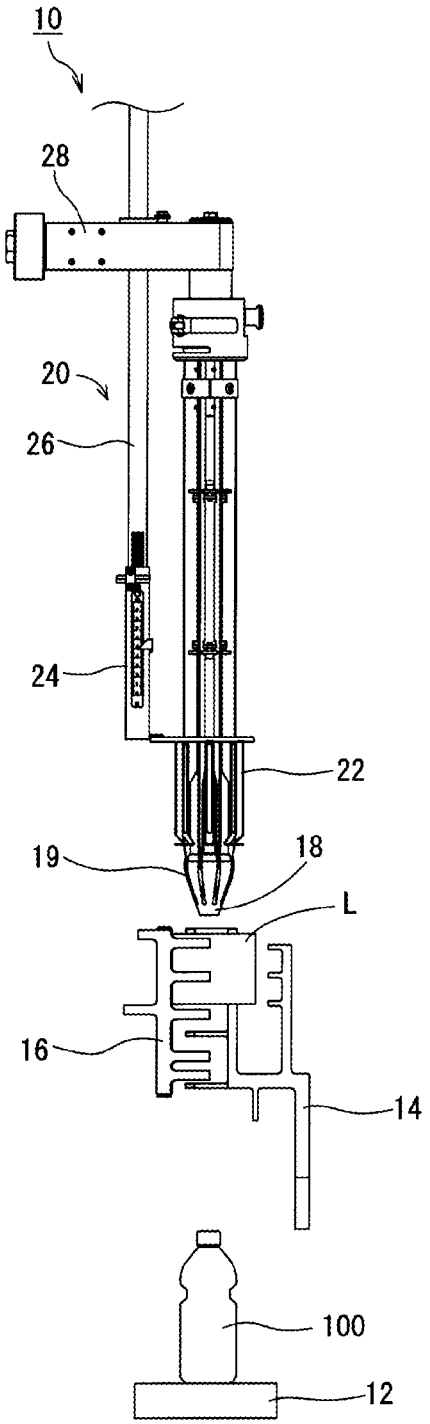
FIG. 1 is a block diagram of a fitting system.
Figure 2:
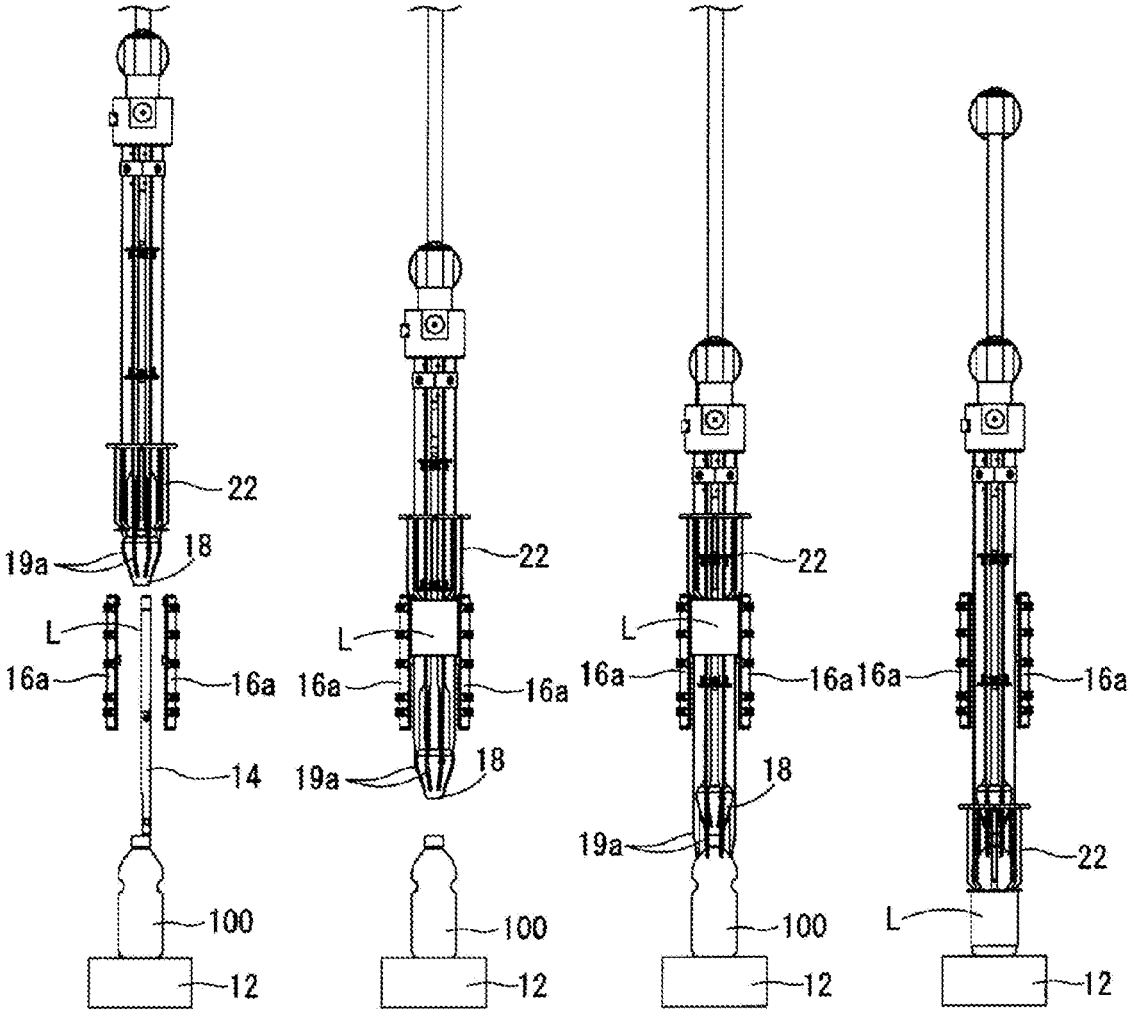
FIG. 2(*a*)

Hereinafter, an embodiment of the present invention will be described with reference to the drawings. FIG. 1 is a diagram showing the configuration of a label fitting system 10 according to an embodiment of the present invention. FIG. 2 is an explanatory diagram of operation of the label fitting system. The label fitting system 10 is a system that fits a cylindrical label L to the outer periphery of a cylindrical container 100. Prior to the description of the label fitting system 10, the container 100 and the label L handled in the present embodiment will be described with reference to FIG. 3.

Figure 3:
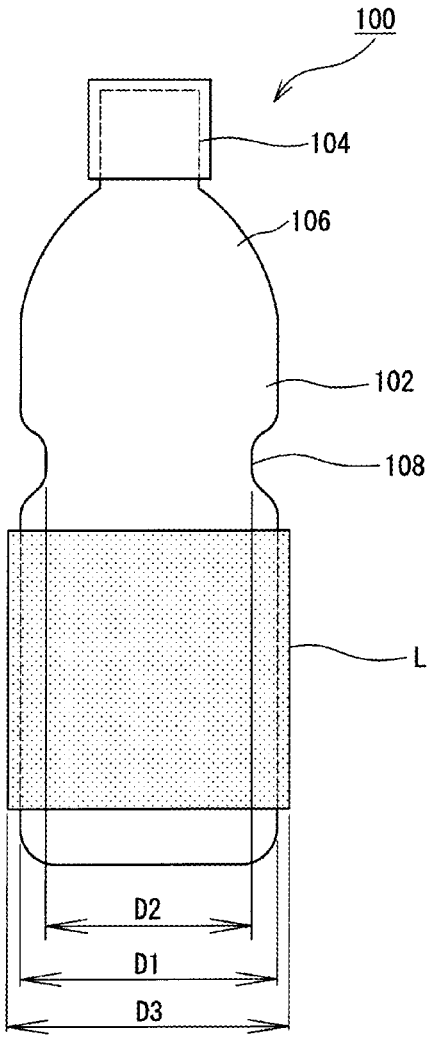
FIG. 3 is a front view of a container to be fitted and a label.

FIG. 3 is a front view of the container 100 to which the label L is fitted.

As shown in FIG. 3, the container 100 is a container in a bottle shape filled with contents such as beverages, chemical liquids, or the like. The container 100 handled in the present embodiment is roughly divided into a trunk portion 102 filled with contents, a spout 104 from which the contents comes out, and a shoulder portion 106 that smoothly connects the trunk portion 102 and the spout 104. The shoulder portion 106 gradually increases in diameter from the spout 104 toward the trunk portion 102. In addition, a narrowed portion 108 reduced partially in diameter is provided in the middle of the trunk portion 102 so as to improve designability and handling properties.

The label L is to be fitted to the outer periphery of the trunk portion 102 and is a shrink label having heat shrinkability. By heating the label L with the label L placed on the outer periphery of the trunk portion 102, the label L is shrunk and brought into close contact with the trunk portion 102 before being attached. In other words, in a state before heat shrinkage, an outside diameter D3 of the label L is slightly larger than a maximum outside diameter D1 of the trunk portion 102. In the present embodiment, the label L is arranged at a position lower than the narrowed portion 108 of the trunk portion 102. Further, the label L is supplied in a state of being folded flat in a sheet shape. In the label fitting system 10, a flatly folded label L is expanded into a cylindrical shape and then attached onto the outer periphery of the container 100.

Next, the label fitting system 10 will be described with reference to FIGS. 1 and 2. As shown in FIG. 1, the label fitting system 10 includes a mounting table 12 on which the container 100 is placed, a take-up member 14 that receives a flatly folded label L, a label opener 16 that opens the flat label L in a cylindrical shape, a mandrel 18 to be inserted into the inside of the label L opened in a cylindrical shape, a bottle pusher 19 that pushes the container 100 so as to restrict the movement of the container 100, and a label arrangement mechanism 20 that pushes down the expanded label L to a predetermined height position.

The take-up member 14 sucks and holds one side of the flat label L supplied from a label supply device (not shown) to receive the label L. Then, the take-up member 14 sends the received label L to the label opener 16. The label opener 16 has a pair of suction members 16*a* sucking and holding the both sides of the flat label L (FIG. 2A). By separating the pair of suction members 16*a* from each other in a state where both sides of the label L are sucked and held, as shown in FIG. 2B, the flat label L is opened in a cylindrical shape. The mandrel 18 is a tapered shaft member. The mandrel 18 can ascend and descend, and after the label L is opened by the label opener 16, the mandrel 18 descends and passes through the label L (FIG. 2B). The bottle pusher 19 is arranged on the outer periphery of the mandrel 18. The bottle pusher 19 has a plurality of leg members 19*a* arranged at intervals in the circumferential direction and can ascend and descend independently of the mandrel 18. The bottle pusher 19 descends together with the mandrel 18 and passes through the label L and then, further descends to press the container 100 against the mounting table 12 at the tip of the leg member 19*a* (FIG. 2C). Thus, the movement of the container 100 is restricted.

The label arrangement mechanism 20 arranges the label L at a predetermined height position by pushing down the upper end of the largely expanded label L. The label arrangement mechanism 20 includes a push-down member 22 capable of ascending and descending. As shown in FIG. 2D, as the push-down member 22 descends, the lower end of the push-down member 22 comes into contact with the upper end of the label L to push down the label L. Accordingly, the label L is arranged at a predetermined height position on the outer periphery of the container 100. After the label L is arranged at the predetermined height position, the push-down member 22 ascends to the initial height position. The container 100 to which the label L is fitted is sent out to a heating device (not shown) for heating to shrink the label L, and a new container 100 is sent to the label fitting system 10.

Next, the configuration of the label arrangement mechanism 20 used in the embodiment will be described in detail. The label arrangement mechanism 20 includes the push-down member 22 that ascends and descends to push down the label L, a support bar 26 supported so as to be able to ascend and descend by a support arm 28, and a relay member 24 interposed between the push-down member 22 and the support bar 26 (see FIG. 1). One end of the push-down member 22 is attached to the relay member 24, and the relay member 24 is attached to the support bar 26. Thus, as the support bar 26 ascends or descends, the relay member 24 and the push-down member 22 also ascend or descend. Incidentally, an ascent/descent profile of the support bar 26, that is, the ascending/descending stroke, the ascending/descending height, and the like are defined by cams. The height position of the relay member 24 with respect to the support bar 26 can be adjusted as described in detail below. By changing the height position of the relay member 24 with respect to the support bar 26, the lowest descent height of the push-down member 22 and eventually, the final arrangement height of the label L can be changed.

Figure 4:
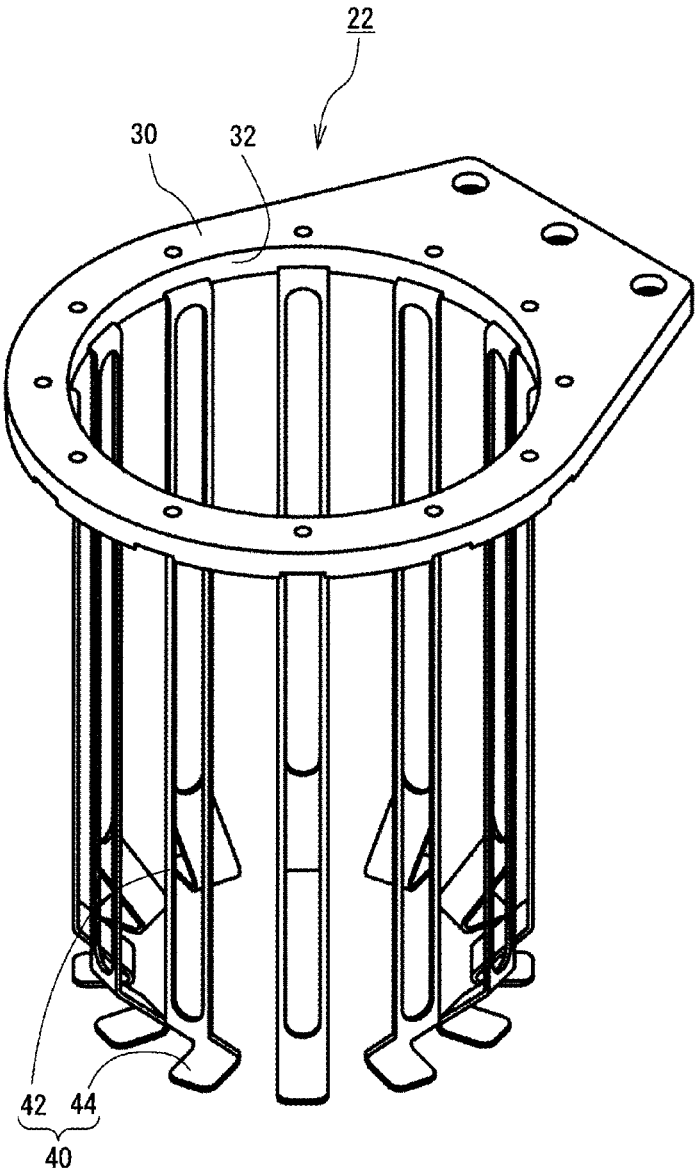
FIG. 4 is a perspective view of a push-down member.
Figure 5:
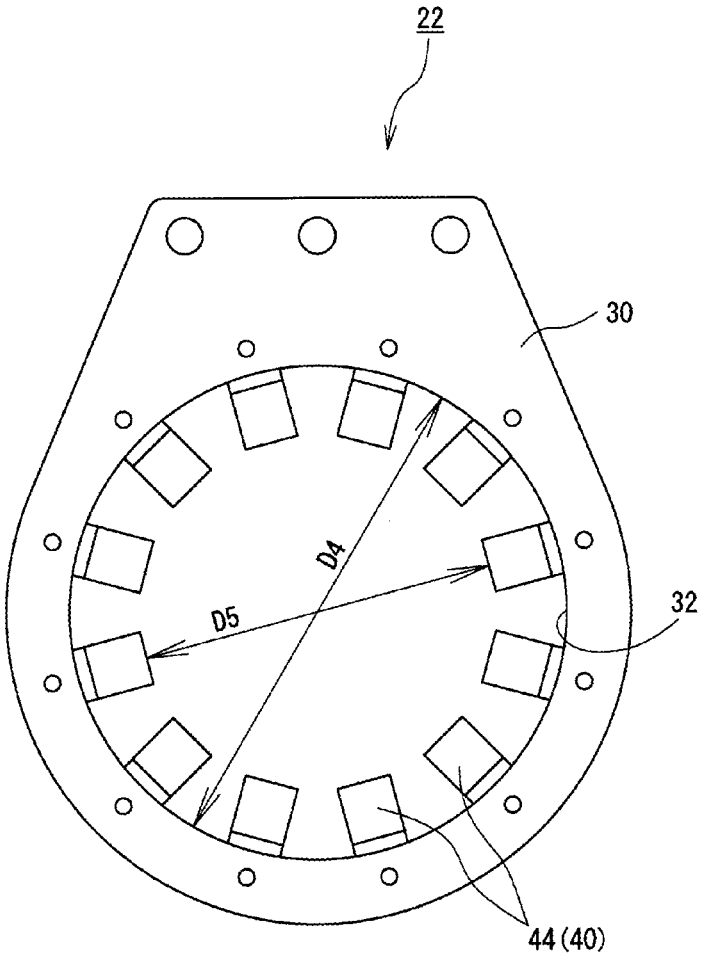
FIG. 5 is a plan view of the push-down member.
Figure 6:
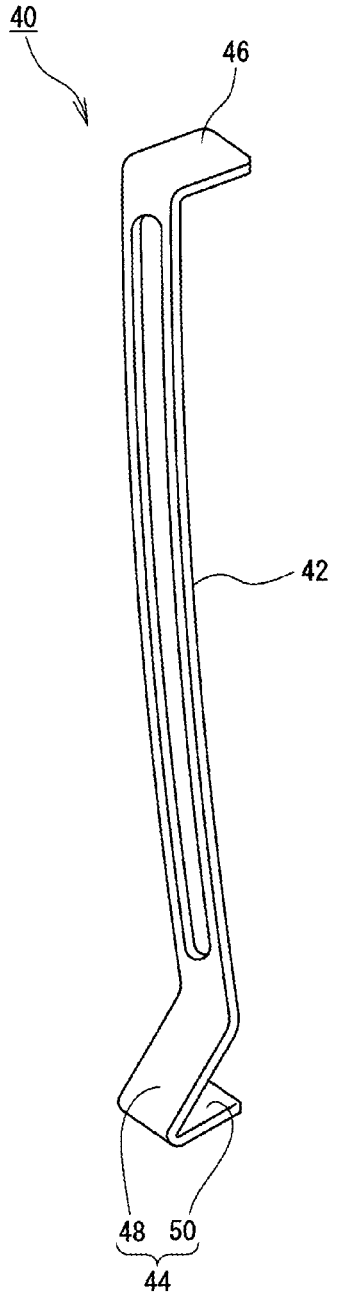
FIG. 6 is a perspective view of a leg.

Next, the configuration of the push-down member 22 will be described in detail. FIG. 4 is a perspective view of the push-down member 22, and FIG. 5 is a plan view of the push-down member 22. FIG. 6 is a perspective view of a leg 40 constituting the push-down member 22. The push-down member 22 includes a base 30 in a substantially annular shape and a plurality (12 in the illustrated example) of the legs 40 extending downward from the base 30. The base 30 is a plate whose upper and lower surfaces are flat, has a circular insertion hole 32 provided at the center thereof, and has, as a whole, a substantially annular shape. One end of the base 30 is connected to the relay member 24.

In some cases, the label fitting system 10 is provided with a bottle pusher 19 (FIG. 1) that presses the shoulder portion 106 of the container 100 downward from above in order to prevent the container 100 from moving when the label L is pushed down. An inside diameter D4 of the insertion hole 32 of the base 30 is larger than the maximum outside diameter of the bottle pusher 19. Therefore, the base 30 can ascend and descend while the bottle pusher 19 arranged inside the insertion hole 32.

The plurality of legs 40 extends downward from the vicinity of the inner peripheral edge of the base 30 in an annular shape. The leg 40 is made of a thin metal plate having moderate elasticity and its length is about ⅓ to ½ of the total height of the container 100. The leg 40 is roughly divided into a leg main body 42 extending downward from the base 30 and a lower end portion 44 continuing to the lower end of the leg main body 42. The leg main body 42 is a portion extending in a direction substantially perpendicular to the base 30, in other words, in a direction parallel to the axial direction of the container 100. However, as shown in FIG. 6, the leg main body 42 may be slightly curved so as to draw an arc that is convex inward in the radial direction and has a large curvature. The leg main body 42 functions like a plate spring that is bent (elastically deformed) by receiving a radial force. When the leg main body 42 is bent, the lower end portion 44 is displaced in the radial direction. The upper end of the leg main body 42 curves radially outward and functions as a fastening portion 46 to be fastened to the base 30.

The lower end portion 44 is further divided roughly into an inward projecting portion 48 projecting radially inward from the lower end of the leg main body 42, and a label contact portion 50 projecting radially outward from the lower end of the inward projecting portion 48. The inward projecting portion 48 extends inward obliquely downward from the lower end of the leg main body 42. The label contact portion 50 is a flat plate-like portion extending in a direction substantially parallel to the base 30 and in a direction substantially perpendicular to the leg main body 42. When the push-down member 22 descends, the bottom face of the label contact portion 50 comes into contact with the upper end face of the label L and pushes the label L down. Connection points between the label contact portion 50 and the inward projecting portion 48 are connected by an arc surface. The connection points formed by the arc surface and the upper surface of the inward projecting portion 48 and the like, function as a contact portion to be in contact with the outer peripheral surface of the container 100 when positioning the label L, and the contact portion has in all cases a smooth surface that smoothly slides on the outer peripheral surface of the container 100.

In a no-load state, the lower end portion 44 protrudes inward from the inner peripheral edge of the base 30 in an annular shape. More specifically, in the no-load state, the inside diameter formed by a plurality of lower end portions 44, that is, a diameter D5 in FIG. 5 is smaller than the outside diameter D2 (FIG. 3) of the narrowed portion 108 of the container 100 to be fitted. Therefore, when the trunk portion 102 of the container 100 is arranged inside the push-down member 22, the lower end portion 44 can always contact the surface of the trunk portion 102 of the container 100 including the narrowed portion 108. In the following description, the inside diameter D5 formed by the plurality of lower end portions 44 is referred to as the "inside diameter D5 of the leg 40".

Figure 7:
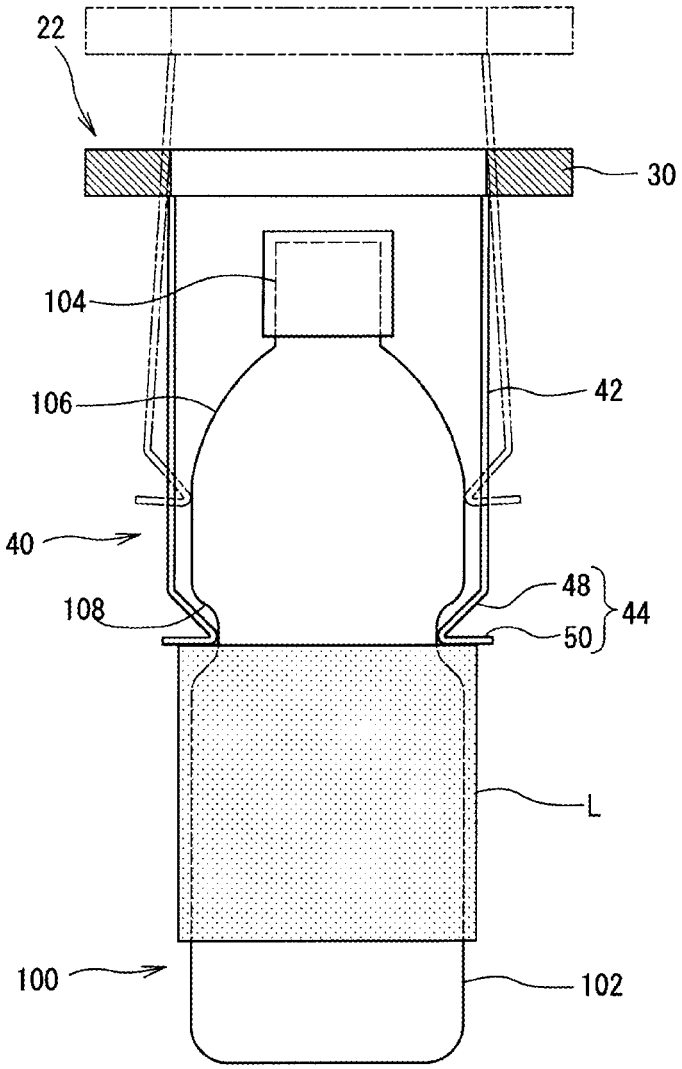
FIG. 7 is a view showing a state where a label is pushed down by the push-down member.

Next, the manner in which the label L is pushed down by the push-down member 22 will be described with reference to FIG. 7. As described with reference to FIG. 2, the label L is widely opened by the label opener 16 in an upper position of the container 100, and the mandrel 18 and the bottle pusher 19 pass through the inside of the label. In this state, the push-down member 22 positioned above the label L starts to descend. As the push-down member 22 descends, the label contact portion 50 provided at the lower end of the leg 40 comes into contact with the upper end of the label L. Then, when the descent of the push-down member 22 is continued, the leg 40 pushes the label L down. Here, the outside diameter D1 of the trunk portion 102 is larger than the inside diameter D5 of the leg 40 in the no-load state. Thus, when the lower end portion 44 of the leg 40 reaches the trunk portion 102, the leg main body 42 is bent so as to widen the inside diameter D5 of the leg 40. Then, the lower end portion 44 of the leg 40 descends while in contact with the surface of the trunk portion 102.

When the lower end portion 44 of the leg 40 reaches the narrowed portion 108, the bending of the leg main body 42 is eliminated due to the elastic restoring force so that the inside diameter D5 of the leg 40 becomes approximately equal to the outside diameter D2 of the narrowed portion 108. That is, according to the present embodiment, the lower end portion 44 of the leg 40 maintains a state in contact with the outer peripheral surface of the container 100 also in the narrowed portion 108. Then, the leg main body 42 is elastically deformed so as to follow the change in diameter of the container 100, and the lower end portion 44 descends while being displaced in the radial direction. That is, the push-down member 22 descends while the lower end portion 44 is in contact with the outer peripheral surface of the container 100. Then, finally, if the label L can be pushed down to the predetermined height position, the push-down member 22 stops descending and ascends instead.

Next, the reason why the push-down member 22 is configured as described above will be described in comparison with the conventional technology. FIGS. 15 and 16 are diagrams showing an example of the push-down member according to the conventional technology. Conventionally, as shown in FIG. 15, a substantially annular plate 70 is used as a push-down member. An insertion hole 72 is formed in the center of the annular plate 70, and the upper end of the label L is pushed down by the annular plate 70.

In such a technology, in order to push down the label L by using the annular plate 70, a diameter D6 of the insertion hole 72 formed in the annular plate 70 needs to be naturally smaller than the diameter D3 of the label L. Further, when the label L is desired to be arranged in the lower portion of the container 100, it is necessary to make the diameter D6 of the insertion hole 72 larger than the outside diameter D1 of the container 100 so that the container 100 can pass through the inside of the insertion hole 72. That is, the diameter D6 of the insertion hole 72 needs to be larger than the outside diameter D1 of the container 100 and smaller than the diameter D3 of the label L. Here, the diameter D3 of the label L cannot be made extremely larger than the outside diameter D1 of the container 100 and the difference therebetween is small. Thus, the difference between the diameter D6 of the insertion hole 72 slightly larger than the container 100 and the diameter D3 of the label L cannot be increased, and it is inevitable that the outside diameter D6 of the insertion hole 72 is slightly smaller than the diameter D3 of the label L. In this case, even if the label L is only slightly deformed or decentered, a portion of the label L enters the inside of the insertion hole 72, leading to a problem that the upper end of the label L cannot be suitably pushed down by the annular plate 70.

Thus, in part, as shown in FIG. 16, the push-down member 22 having a plurality of claw members 74 provided around the insertion hole 72 of the annular plate 70 is also proposed. In this case, the claw member 74 is energized by a spring (not shown) so as to rotate about a support shaft 76 of the base end portion. With this energizing force, the tip of the claw member 74 can push down the label L while in contact with the outer surface of the container 100. In such a configuration, a portion of the label L is prevented from entering the gap between the claw member 74 and the outer peripheral surface of the container 100. Accordingly, the label L is suitably pushed down by the claw member 74.

However, in the case of the structure shown in FIG. 16, the distance from the tip of the claw member 74 (the contact portion with the container 100) to the rotation center (the support shaft 76) is short. Thus, in order to follow the change in outside diameter of the container 100, the claw member 74 needs to significantly rotate obliquely downward, which changes the posture of the claw member 74 considerably. As a result, in the case of the container 100 having the narrowed portion 108, there is a problem that the claw member 74, which is greatly inclined, is caught by the narrowed portion 108 during the ascent.

For example, in FIG. 16, when the claw member 74 ascends from the height position indicated by the solid line, that is, a case where the tip of the claw member 74 ascends from the state where the tip is in contact with the upper tapered surface of the narrowed portion 108 will be considered. When ascending from this height position, the tip of the claw member 74 needs to move radially outward to follow the change in diameter of the container 100. However, the claw member 74 cannot move straight outward in the radial direction, and when moving outward in the radial direction, the claw member 74 also needs to move upward at the same time, that is, to move outward obliquely upward as a whole (direction of the arrow in FIG. 16). However, in the state shown in FIG. 16, the upper tapered surface of the narrowed portion 108 is in contact with the upper side of the claw member 74, and the outward rotation in an obliquely upward direction of the claw member 74 is hindered. As a result, the claw member 74 cannot move outward in the radial direction and is caught by the narrowed portion 108, which prevents the claw member 74 from ascending. That is, in the configuration of FIG. 16, it is difficult to fit the label L to the container 100 having the narrowed portion 108.

As described above, the push-down member 22 in the present embodiment has the leg 40 extending downward from the base 30. The leg 40 is displaced by its own elasticity, and the lower end portion 44 of the leg 40 comes into contact with the outer peripheral surface of the container 100. Because the lower end portion 44 ascends and descends while in contact with the outer peripheral surface of the container 100, the label L does not enter the gap between the lower end portion 44 and the container 100 and the label L can be suitably pushed down.

Further, in the present embodiment, the leg 40 has the length of about 1/3 to 1/2 of the total height of the container 100 and has the leg main body 42 in which the distance from the base 30 to the lower end portion 44 is long, that is, extending in the longitudinal direction. Thus, according to the present embodiment, when the leg 40 is displaced in the radial direction in order to follow the change in outside diameter of the container 100, the leg main body 42 is bent so that the lower end portion 44 is displaced in a direction substantially perpendicular to the container 100. Therefore, unlike the configuration of FIG. 16, the lower end portion 44 is prevented from being caught on the upper tapered surface of the narrowed portion 108 in the process of ascending, and even the container 100 having the narrowed portion 108 can easily ascend and descend. As a result, the label L can also be arranged at a predetermined height position for the container 100 having the narrowed portion 108.

Figure 8:
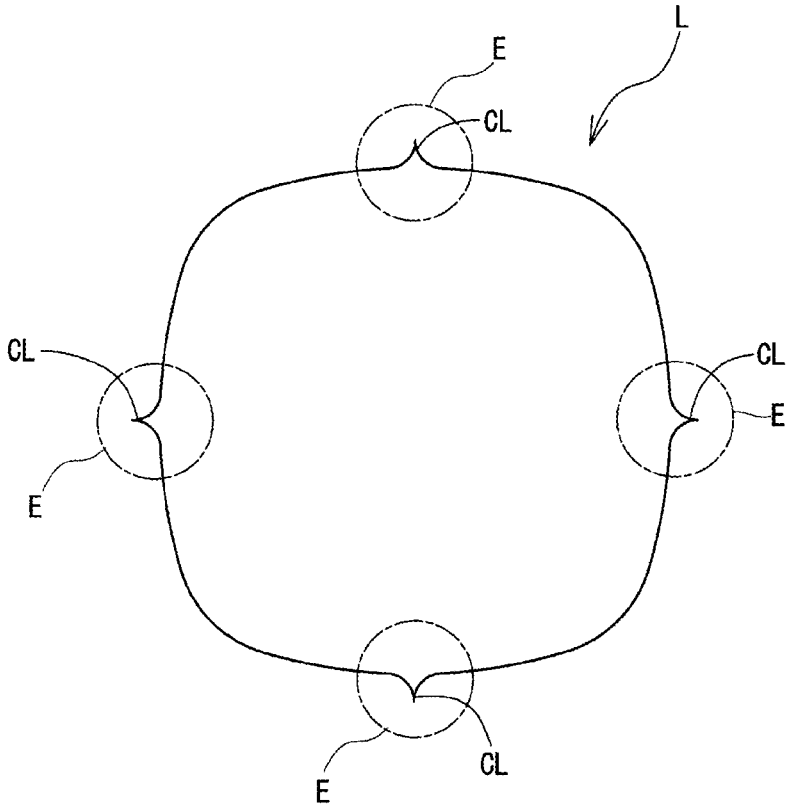
FIG. 8 is a plan view of the label.

Incidentally, in recent years, there is a tendency to reduce the thickness of the label L from the viewpoint of consideration for the natural environment, cost reduction, and the like. As a result, the rigidity of the label L decreases, and the label L easily bends even with a relatively small force. Thus, when the label L is pushed down by the push-down member 22, the label L may buckle because the label L cannot withstand the push-down force. In order to reduce the buckling of such a thin label L, in the present embodiment, the label contact portion 50 is brought into contact with the vicinity of the fold of the label L. This will be described with reference to FIG. 8. FIG. 8 is a schematic plan view of the label L opened by the label opener 16. As already described above, the label L is usually supplied in a flatly folded state. In addition, the label L may be folded back so that its folding position changes in the process of supplying the label L in order to enhance openability of the label L. As a result, as shown in FIG. 8, there are two or four mountain-like folds CL (four in the example of FIG. 8) on the outer side of the label L supplied to the container 100. By virtue of the fold CL, the vicinity of the fold CL is less likely to be bent than positions without the fold CL. Thus, in the present embodiment, at least a portion of a plurality of label contact portions 50 is brought into contact with the fold CL or the vicinity of the fold CL, that is, a position within a region E in FIG. 8 to push down the label L. By adopting such a configuration, buckling of the label L can be effectively suppressed.

Further, the configuration of the push-down member 22 described above is merely an example, and includes at least the base 30 and the plurality of legs 40 and, as long as the lower end portion 44 of the leg 40 can be displaced in the radial direction, other components may be changed as appropriate. For example, in the present embodiment, the number of the legs 40 is 12, but the number of the legs 40 is not particularly limited as long as the number of the legs 40 is two or more. However, in order to prevent buckling of the label L, the larger the number of the legs 40, the more preferable and the number of the legs 40 is at least four or more, and more preferably eight or more. In addition, it is preferable that the force pressing the upper end of the label L be evenly distributed in the circumferential direction and thus, the plurality of legs 40 is preferably arranged at equal intervals in the circumferential direction. However, the plurality of legs 40 may be unequally arranged in the circumferential direction depending on the arrangement relationship with other members, the position in contact with the label L, or the like.

Further, in the present embodiment, the inward projecting portion 48 is provided between the leg main body 42 and the label contact portion 50, but the inward projecting portion 48 may be omitted. That is, the label contact portion 50 extending inward in the radial direction from the lower end of the leg main body 42 may be provided so that the leg 40 as a whole is configured in a substantially L shape.

Figure 9:
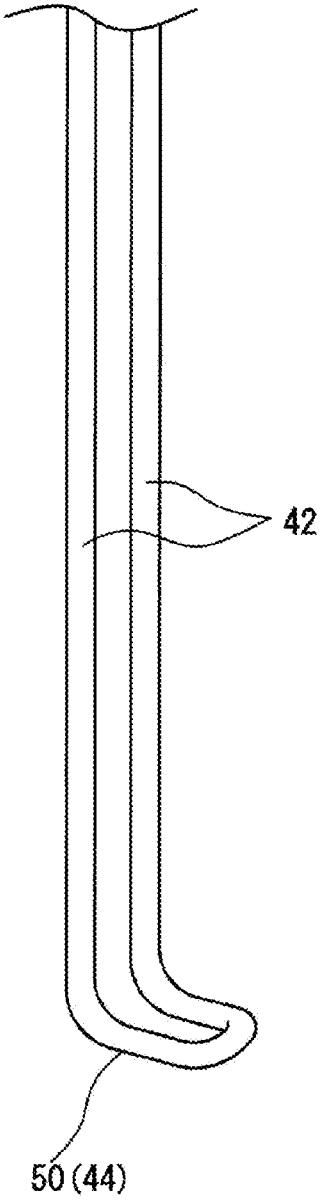
FIG. 9(*a*) and FIG. 9(*b*) are views showing an example of another leg.
Figure 9:
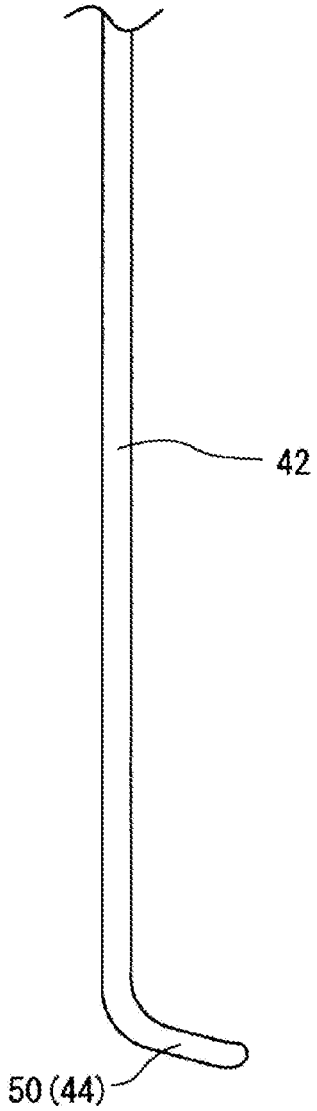

In addition, the leg 40 is not limited to a metal plate as long as the leg 40 has moderate elasticity and may be made of other materials. For example, the leg 40 may be a plate-like member made of resin or the like having elasticity. Further, as shown in FIG. 9, the leg 40 may be formed of a wire made of metal or the like. In the example of FIG. 9A, the leg 40 is formed of a linear member folded back in a U shape. The vicinity (the lower end portion 44) of the folded-back portion of the U-shaped linear member is bent inward in the radial direction by approximately 90 degrees to constitute the label contact portion 50. As another form, as shown in FIG. 9B, a single linear member whose the end is bent into a substantially L shape may be used as the leg 40. In this case, a portion bent inward in the radial direction at the end of the linear member constitutes the label contact portion 50. In this case, the inner end portion of the label contact portion 50 becomes a contact portion that comes into contact with the outer peripheral surface of the container 100. The end of the linear member is preferably processed in some way so that the contact portion does not damage the outer peripheral surface of the container 100. More specifically, chamfering the inner end portion (the end of the linear member) of the label contact portion 50 in a hemispherical shape or curving the inner end portion in an arc shape so as to be a smooth surface can be considered. As another configuration, it is also conceivable to attach an elastic material, such as rubber or sponge, softer than the outer peripheral surface of the container 100 to the inner end portion. Further, the leg 40 may have a configuration combining the leg main body 42 made of a single linear member shown in FIG. 9B and the lower end portion 44 made of a linear member folded back in a U shape shown in FIG. 9A.

Next, adjustments of the descent start position of the push-down member 22 described above and adjustments of the final arrangement height of the label L will be described. As already described above, the push-down member 22 is connected to the support bar 26 via the relay member 24 and as the support bar 26 ascends and descends, the push-down member 22 ascends and descends. An ascent/descent profile (the ascending/descending stroke, the ascending/descending start height, and the like) of the support bar 26 is defined by cams, and large-scale work such as replacement of cams is needed to change the ascent/descent profile. Thus, the ascent/descent profile of the support bar 26 cannot be easily changed. On the other hand, the shape of the container 100 to be fitted and the size of the label L are different for each product and it is desired that the final arrangement height of the label L can be easily changed. Replacing the cam each time the shape of the container 100 or the size of the label L is changed is a heavy burden for a user.

Figure 10:
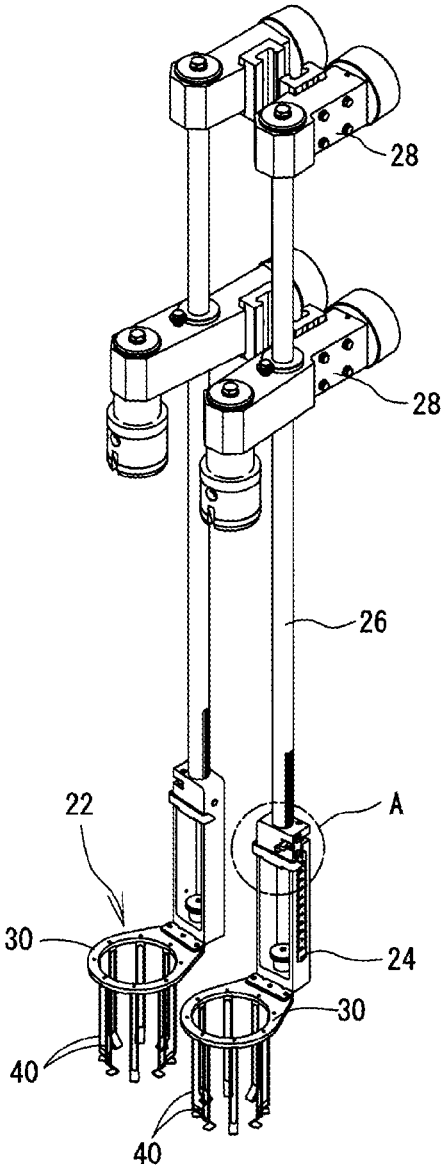
FIG. 10 is a perspective view of a support bar and a relay member.
Figure 11:
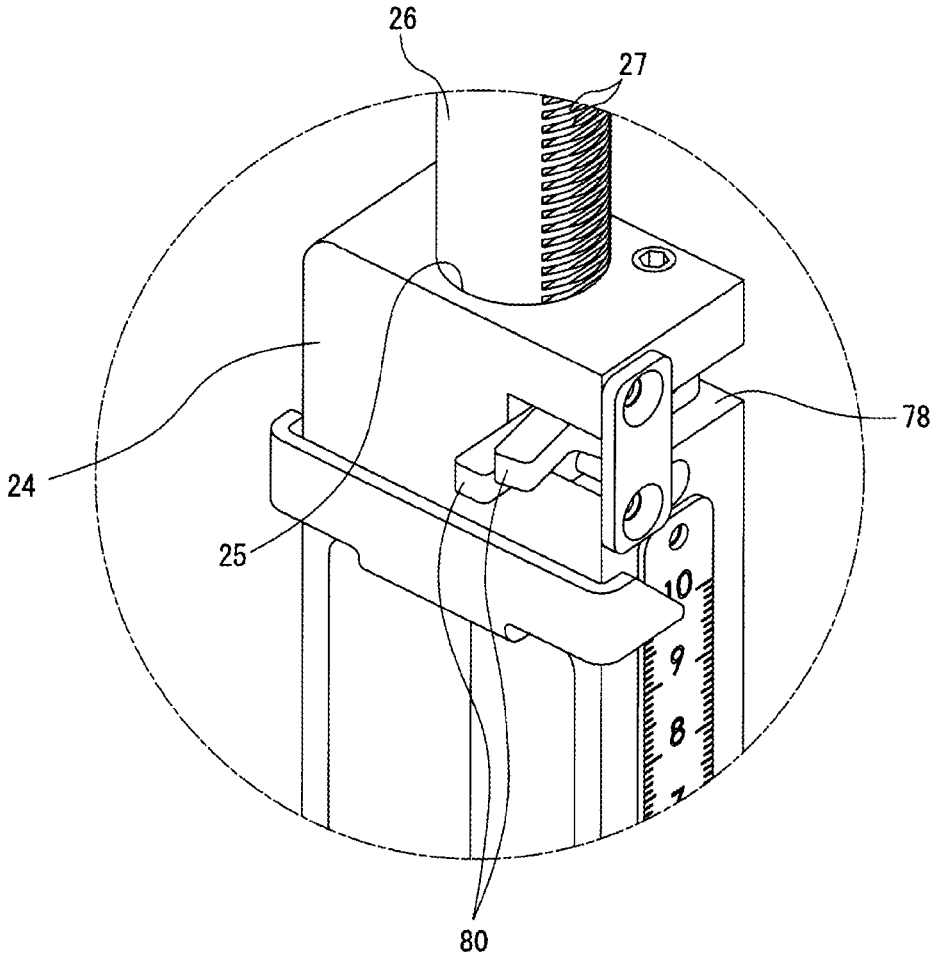
FIG. 11 is an enlarged view of a portion A in FIG. 11.
Figure 12:
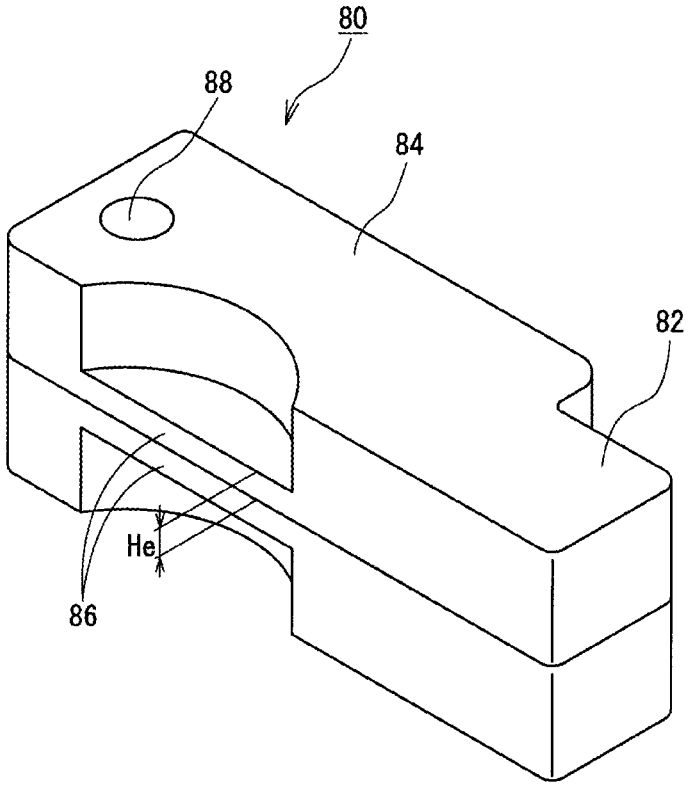
FIG. 12 is a perspective view of a lever used for height adjustment.
Figure 13:
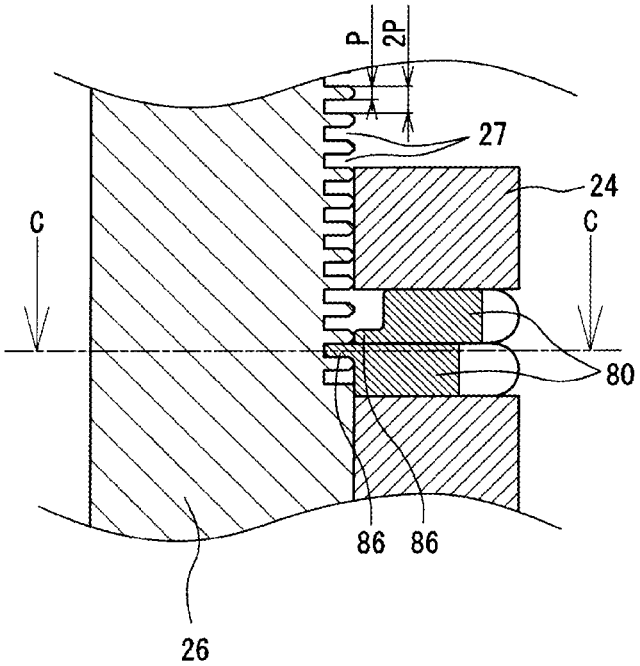
FIG. 13 is a vertical cross-sectional view around the lever.
Figure 14:
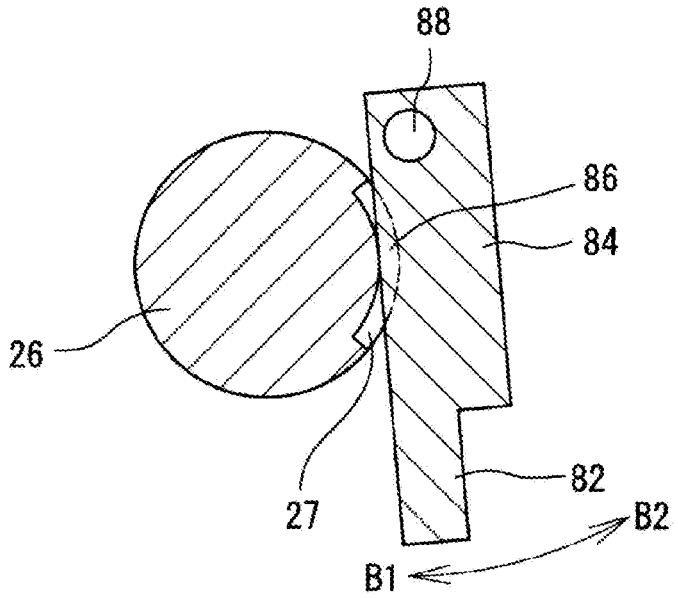
FIG. 14(*a*) is a sectional view taken along C-C in FIG. 13, and FIG. 14(*b*) is a view showing a state when the lever is rotated in a B2 direction.
Figure 14:
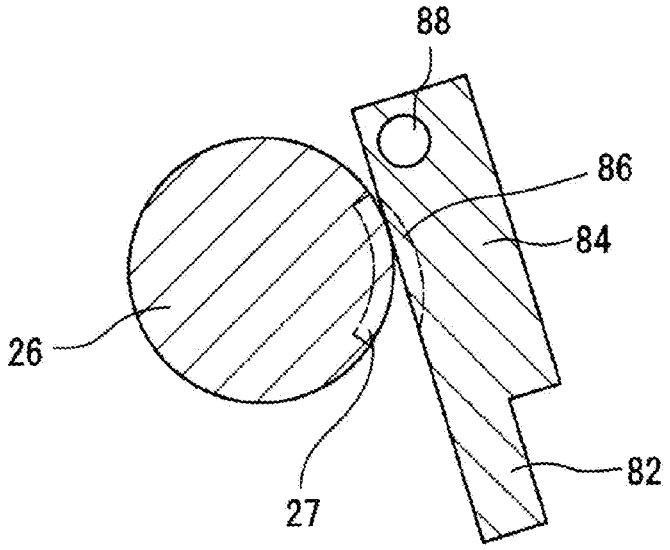

Thus, in the present embodiment, by making the height position of the relay member 24 with respect to the support bar 26 adjustable and changing the height of the relay member 24, the descent start position of the push-down member 22 and the arrangement position of the label L can be changed. FIG. 10 is a perspective view of the relay member 24 and the support bar 26 and FIG. 11 is an enlarged view of a portion A in FIG. 10. FIG. 12 is a perspective view of a lever 80 used for adjusting the height, FIG. 13 is a vertical cross-sectional view around the lever 80, and FIG. 14 is a sectional view taken along C-C in FIG. 13.

In order to make the height of the relay member 24 adjustable, a plurality of engagement grooves 27 provided in the vicinity of the lower end of the support bar 26 and a pair of levers 80 fixed to the relay member 24 are provided. The plurality of engagement grooves 27 is formed in the vicinity of the lower end of the support bar 26 at equal intervals (for example, at intervals of 2 mm) in the axial direction. The arrangement pitch of the engagement grooves 27 is approximately twice the groove width P of each engagement groove 27, that is, 2P.

The relay member 24 has a guide hole 25 into which the lower end of the support bar 26 is inserted. Further, a notch portion 78 is provided on the side surface of the relay member 24, and the pair of levers 80 is mounted in the notch portion 78. FIG. 12 is a perspective view of the two levers 80 stacked one above the other. As shown in FIG. 12, each of the levers 80 has a substantial flag shape including an operation portion 82, which has a narrow width, and a main body portion 84, which is wider than the operation portion 82. The lever 80 is provided with a shaft hole 88 in the vicinity of the opposite side end portion of the operation portion 82 and is mounted in the notch portion 78 so as to be rotatable around the shaft hole 88. When the lever 80 is mounted in the notch portion 78, the direction of the shaft hole 88 is the vertical direction, and the lever 80 rotates in the horizontal direction.

The operation portion 82 projects to the outside of the notch portion 78, and a user operates the operation portion 82 to rotate the lever 80. One end in the width direction of the main body portion 84 is cut out in a substantial arc shape and is partially thinned. The thin portion functions as an engaging portion 86 engaging with the engagement groove 27 formed on the support bar 26. A vertical height He of the engaging portion 86 is slightly smaller than a groove width P (about 1 mm in the present embodiment) of the engagement groove 27 so that the engaging portion 86 can be fitted into the engagement groove 27.

The lever 80 described above is stacked vertically so that the respective engaging portions 86 are adjacent to each other and arranged in the notch portion 78 (see FIG. 13). Further, in each of the levers 80, the engaging portion 86 is energized by a spring (not shown) in a direction (B1 direction in FIG. 14) approaching the engagement groove 27.

When it is desired to change the height of the relay member 24, the two levers 80 are pushed against the energizing force of the spring in a direction in which each of the engaging portions 86 move away from the support bar 26, that is, in the direction of an arrow B2 in FIG. 14. Accordingly, the engagement between the engaging portion 86 and the engagement groove 27 is released, and the relay member 24 can ascend and descend with respect to the support bar 26. In this state, a user raises or lowers the relay member 24 along the support bar 26 to change the height of the relay member 24 to a desired height. When the desired height is reached, the user releases the levers 80. When the user releases the levers 80, the two levers 80 attempt to move in a direction in which each of the engaging portions 86 approach the support bar 26, that is, in the direction of an arrow B1 in FIG. 14 due to the energizing force of the spring. Then, as shown in FIGS. 13 and 14A, the engaging portion 86 of one of the two levers 80 is fitted into the engagement groove 27 so that the relay member 24 is fixed to a desired height position. At this point, as shown in FIGS. 13 and 14B, the engaging portion 86 of the other lever 80 is not fitted into the engagement groove 27 due to the pitch of the engagement groove 27 and is in contact with the outer surface of the support bar 26 instead.

In the present embodiment, as is clear from the above description, by operating the lever 80 provided in the relay member 24, the height of the relay member 24 can be changed. As a result, the arrangement height of the label L can be changed without replacing the cams that defines the ascent/descent profile of the support bar 26, and the versatility of the label fitting system 10 can be further improved.

Further, in the present embodiment, the two levers 80 having engaging portions 86 are provided. As a result, the height of the relay member 24 can be changed by the pitch P which is half of the arrangement pitch 2P of the engagement groove 27. That is, in the present embodiment, the engagement groove 27 having a width of 1 mm is formed with a pitch of 2 mm. When only one lever 80 is used, the moving pitch of the relay member 24 is unavoidably 2 mm same as the pitch of the engagement groove 27. On the other hand, when the two levers 80 are stacked in the vertical direction, as shown in FIG. 13, the moving pitch of the relay member 24 can be made 1 mm. For example, in the state shown in FIG. 13, the lever 80 on the lower side is engaged with the engagement groove 27, but if the engagement is released from this state and then, the relay member 24 is moved upward or downward by 1 mm, the lever 80 on the upper side can be engaged with the engagement groove 27 this time. Then, by engaging the lever 80 on the upper side with the engagement groove 27, the height of the relay member 24 is fixed after the relay member 24 being moved by P (1 mm) which is half the arrangement pitch 2P (2 mm) of the engagement groove 27. That is, by providing two levers 80, it is possible to change the height of the relay member 24 and the arrangement height of the labels L by the pitch P that is half the arrangement pitch 2P of the engagement groove 27, which enables finer positioning.

It should be noted that the height adjustment mechanism described here is only an example and may be changed as appropriate. For example, other known mechanisms may be used as a height adjustment mechanism of the push-down member 22, or the height adjustment mechanism itself may be omitted. In any case, by pushing down the label L using the push-down member 22 having the plurality of leg 40 as described above, the label L can be suitably arranged on even the container 100 having the narrowed portion 108.

REFERENCE SIGNS LIST 10 label fitting system
12 mounting table
14 take-up member
16 label opener
18 mandrel
19 bottle pusher
20 label arrangement mechanism
22 push-down member
24 relay member
25 guide hole
26 support bar
27 engagement groove
28 support arm
30 base
32, 72 insertion hole
40 leg
42 leg main body
44 lower end portion
46 fastening portion
48 inward projecting portion
50 label contact portion
70 annular plate
74 claw member
76 rocking shaft
78 notch portion
80 lever
82 operation portion
84 main body portion
86 engaging portion
88 shaft hole
100 container
102 trunk portion
106 shoulder portion
108 narrowed portion
CL fold
L label

The invention claimed is:

1. A label fitting system that fits a cylindrical label to an outer periphery of a cylindrical container, the label fitting system comprising:
a label arrangement mechanism that arranges the cylindrical label supplied above the cylindrical container, on the outer periphery of the cylindrical container by pushing down the cylindrical label,
wherein
the label arrangement mechanism includes:
a base in an annular shape capable of ascending and descending; and
a plurality of legs extending downward from the base,
each leg of the plurality of legs has elasticity capable of being displaced in a radial direction and further has a lower end portion that comes into contact with an upper end of the cylindrical label, and
when the base descends, the lower end portion of each leg of the plurality of legs pushes down the cylindrical label as descending along an outer peripheral surface of the cylindrical container.

2. The label fitting system according to claim 1, wherein
each leg of the plurality of legs has a leg main body extending downward from the base and
the lower end portion of each leg of the plurality of legs has a label contact portion extending in the radial direction.

3. The label fitting system according to claim 2, wherein
the label contact portion is provided so as to project radially inward from a lower end of the leg main body.

4. The label fitting system according to claim 3, wherein
the label contact portion is provided in a direction substantially perpendicular to the leg main body.

5. The label fitting system according to claim 3, wherein each leg of the plurality of legs is arranged so as to extend downward in a direction substantially perpendicular to the base in a no-load state, and the lower end portion of each leg of the plurality of legs projects inward from an inside diameter position of the base.

6. The label fitting system according to claim 2, wherein the lower end portion has an inward projecting portion projecting radially inward from a lower end of the leg main body and the label contact portion is provided so as to project radially outward from a lower end of the inward projecting portion.

7. The label fitting system according to claim 6, wherein the label contact portion is provided in a direction substantially perpendicular to the leg main body.

8. The label fitting system according to claim 2, wherein the label contact portion is provided in a direction substantially perpendicular to the leg main body.

9. The label fitting system according to claim 2, wherein each leg of the plurality of legs is arranged so as to extend downward in a direction substantially perpendicular to the base in a no-load state, and the lower end portion of each leg of the plurality of legs projects inward from an inside diameter position of the base.

10. The label fitting system according to any of claim 2, wherein each leg of the plurality of legs is made of a plate member or a linear member.

11. The label fitting system according to claim 2, wherein each leg of the plurality of legs is made of a linear member and at least the linear member is formed in a U shape in the lower end portion.

12. The label fitting system according to claim 2, wherein the lower end portion of each leg of the plurality of legs has a smooth surface in contact with the outer peripheral surface of the cylindrical container when descending.

13. The label fitting system according to claim 2, wherein at least four legs of the plurality of legs are provided at equal intervals in a circumferential direction of the base.

14. The label fitting system according to claim 2, wherein at least eight legs of the plurality of legs are provided at equal intervals in a circumferential direction of the base.

15. The label fitting system according to claim 1, wherein each leg of the plurality of legs is arranged so as to extend downward in a direction substantially perpendicular to the base in a no-load state, and the lower end portion of each leg of the plurality of legs projects inward from an inside diameter position of the base.

16. The label fitting system according to any of claim 1, wherein each leg of the plurality of legs is made of a plate member or a linear member.

17. The label fitting system according to claim 1, wherein each leg of the plurality of legs is made of a linear member and at least the linear member is formed in a U shape in the lower end portion.

18. The label fitting system according to claim 1, wherein the lower end portion of each leg of the plurality of legs has a smooth surface in contact with the outer peripheral surface of the cylindrical container when descending.

19. The label fitting system according to claim 1, wherein at least four legs of the plurality of legs are provided at equal intervals in a circumferential direction of the base.

20. The label fitting system according to claim 1, wherein at least eight legs of the plurality of legs are provided at equal intervals in a circumferential direction of the base.

* * * * *